US010378135B2

(12) United States Patent
Grassl

(10) Patent No.: US 10,378,135 B2
(45) Date of Patent: Aug. 13, 2019

(54) GLASS FIBRE MAT AND PRODUCTS CONTAINING GLASS FIBRE MATS

(71) Applicant: JOHNS MANVILLE, Denver, CO (US)

(72) Inventor: Thomas Grassl, Cranberry Township, PA (US)

(73) Assignee: Johns Manville, Denver, CO (US)

( * ) Notice: Subject to any disclaimer, the term of this patent is extended or adjusted under 35 U.S.C. 154(b) by 249 days.

(21) Appl. No.: 15/097,671

(22) Filed: Apr. 13, 2016

(65) Prior Publication Data

US 2016/0230319 A1 Aug. 11, 2016

Related U.S. Application Data

(63) Continuation of application No. 13/983,283, filed on Aug. 6, 2013, now abandoned.

(51) Int. Cl.

| | |
|---|---|
| ***D04H 1/587*** | (2012.01) |
| ***D04H 1/593*** | (2012.01) |
| ***D04H 1/64*** | (2012.01) |
| ***D04H 1/4218*** | (2012.01) |
| ***D06N 7/00*** | (2006.01) |
| ***D04H 1/4382*** | (2012.01) |

(52) U.S. Cl.

CPC ..... *D04H 1/587* (2013.01); *D04H 1/4218* (2013.01); *D04H 1/4382* (2013.01); *D04H 1/593* (2013.01); *D04H 1/64* (2013.01); *D06N 7/006* (2013.01); *D06N 7/0007* (2013.01); *D06N 2201/082* (2013.01); *D06N 2203/048* (2013.01); *D06N 2205/04* (2013.01); *D06N 2211/066* (2013.01); *D10B 2101/06* (2013.01); *D10B 2503/04* (2013.01)

(58) Field of Classification Search

CPC ..... D01H 1/587; D01H 1/64; D01H 1/4218; D06N 7/006; D06N 3/06; D06N 2203/048; D06N 2211/066; D10B 2101/06; D10B 2503/04

See application file for complete search history.

(56) References Cited

U.S. PATENT DOCUMENTS

| | | | | |
|---|---|---|---|---|
| 4,129,674 | A | 12/1978 | Hannes et al. | |
| 4,138,521 | A | 2/1979 | Brown | |
| 4,167,404 | A | 9/1979 | Loeffler et al. | |
| 4,532,006 | A | 7/1985 | Winters et al. | |
| 4,637,951 | A * | 1/1987 | Gill | D04H 1/64 428/215 |
| 5,670,585 | A | 9/1997 | Taylor et al. | |
| 6,267,843 | B1 | 7/2001 | Helwig | |
| 2004/0266304 | A1 * | 12/2004 | Jaffee | B28B 19/0092 442/386 |
| 2007/0293646 | A1 * | 12/2007 | Gosse | C08K 5/12 526/344 |
| 2008/0038546 | A1 | 2/2008 | Kuik | |
| 2008/0161177 | A1 | 7/2008 | Bauer et al. | |

FOREIGN PATENT DOCUMENTS

| | | | |
|---|---|---|---|
| EP | 0267470 | A1 | 5/1988 |
| JP | 04198226 | A | 7/1992 |
| WO | 2006087426 | A1 | 8/2006 |

OTHER PUBLICATIONS

Bernstein, D. M. and Sintes, J.M.R., "Methods for the Determination of the Hazardous Properties for Human Health of Man Made Mineral Fibers (MMM)", European Chemicals Bureau, Apr. 1999.

The Free Dictionary, "porosity", Farlex, Inc., 2015, www.thefreedictionary.com/porosity.

The Free Dictionary, "permeability", Farlex, Inc., 2015, www.thefreedictionary.com/permeability.

Tsukamoto, M. and Ito, S., "Corrosion-Resistant Reinforced Resin Pipe", JPH04198226(a), Bibliographic Data, EPO machine translation to English, Jul. 17, 1992.

Tsukamoto, M. and Ito, S., "Corrosion-Resistant Reinforced Resin Pipe", JPH04198226(a), Bibliographic Data, USPTO machine translation to English, Jul. 17, 1992.

* cited by examiner

*Primary Examiner* — Jeremy R Pierce
(74) *Attorney, Agent, or Firm* — Robert D. Touslee

(57) ABSTRACT

A glass fiber mat comprises glass fibers of a first kind, glass fibers of a second kind and a binding agent. Glass fibers of the first kind in this case are characterized by a mean fiber diameter of under 6 μm and compliance with the EC Protocol "ECB/TM/27 rev. 7" and glass fibers of the second kind by a mean fiber diameter of over 6 μm. The ratio between the weight component of glass fibers of the first kind and the weight component of glass fibers of the second kind is between 0.01 and 0.15. And the surface weight of the glass fiber mat is between 25 g/m2 and 80 g/m2. In a CV floor covering comprising a usable layer and a structural layer, the structural layer comprises a glass fiber mat of this kind provided with impregnation.

22 Claims, No Drawings

GLASS FIBRE MAT AND PRODUCTS CONTAINING GLASS FIBRE MATS

CROSS REFERENCE TO RELATED APPLICATIONS

This application is a continuation of now abandoned U.S. patent application Ser. No. 13/983,283 filed Aug. 6, 2013 which was the National Stage of International Application No. PCT/EP2012/000604, filed Feb. 10, 2012, which claimed priority to German Patent Application No. 10-2011-01105 filed on Feb. 11, 2011. The entire contents of all these applications are incorporated herein by reference for all purposes.

BACKGROUND OF THE INVENTION

The present invention relates to a glass fibre mat. It further relates to products containing glass fibre mats, particularly a CV floor covering comprising a glass fibre mat as a structural layer.

Glass fibre mats are known in multifarious embodiments and for various applications. Also known are customary methods of producing glass fibre mats from glass fibres and binders. A significant application of glass fibre mats is their use as a carrier material in floor coverings, particularly in CV (Cushioned Vinyl) floor coverings. During the production of CV floor coverings, the glass fibre mat is typically initially impregnated in a first step with a PVC paste (particularly Plastisol). For this purpose, the PVC paste is usually applied to the glass fibre mat by means of a coating knife in a predetermined layer thickness or with a predetermined surface weight (e.g. approx. 400 g/m$^2$). A further layer of PVC paste is then applied to the glass fibre mat impregnated in such a way, wherein the surface weight of this second layer can typically lie roughly within the same order of magnitude as the impregnating coating. The back foaming, i.e. the application of an elastically flexible coating to the back side of the glass fibre mat, then takes place. The usable side can then receive a final finishing, for example by means of a coating of clear varnish or other special coatings. This kind of production of CV floor coverings has been known in the PVC industry for some time and is widely used in different variants.

Various requirements are made of the glass fibre mat forming the carrier layer in this respect, some of which are to some extent in conflict with one another. Hence, the glass fibre mat should exhibit good mechanical strength, namely both during the processing and also during the use of the floor covering designed and produced using said glass fibre mat. It is therefore important for both the PVC paste and also the back foaming to create an optimal mechanical connection with the glass fibre mat, so that these layers are prevented from separating from the glass fibre mat when the floor covering is in use. On the other hand, the PVC paste, which is applied to the glass fibre mat by means of a coating knife, as described above, must be prevented from penetrating through said glass fibre mat. This is because otherwise more or less noticeable lumps of PVC form on the back side of the glass fibre mat, where the backing foam is to be applied subsequently, which has a substantially adverse effect on the level of comfort when walking on the CV floor covering. Furthermore, as usual cost considerations play a part, both in relation to the production of the glass fibre mat and also in relation to the impregnation thereof with PVC paste, in which case the consumption of PVC paste for impregnation is crucially dependent on the thickness and the properties (pore volume, permeability, absorbability, pore size distribution) of the glass fibre mat.

BRIEF SUMMARY OF THE INVENTION

The present invention is aimed at providing a glass fibre mat which is ideally suited for use as a carrier material in a CV floor covering, in that is satisfies all the requirements described above in a practical manner and, to this extent, is superior to the prior art in its overall properties.

DETAILED DESCRIPTION OF THE INVENTION

This problem is solved according to the present invention, as indicated in claim 1, by a glass fibre mat comprising glass fibres of a first kind, glass fibres of a second kind and a binding agent, wherein the glass fibres of the first kind are characterized by a mean fibre diameter of under 6 μm and compliance with the EC Protocol "ECB/TM/27 rev. 7" and the glass fibres of the second kind are characterized by a mean fibre diameter of over 6 μm, wherein furthermore the ratio between the weight component of glass fibres of the first kind and the weight component of glass fibres of the second kind is between 0.01 and 0.15 and, in addition, the surface weight of the glass fibre mat is between 25 g/m$^2$ and 80 g/m$^2$.

In other words, therefore, a specific combination of synergistically interacting features is characteristic of the glass fibre mat according to the invention, such that it comprises various glass fibres connected to one another by means of a binding agent, namely relatively thin glass fibres of the first kind on the one hand, i.e. those with a mean fibre diameter of under 6 μm and, on the other hand, relatively thick glass fibres of the second kind, i.e. those with a mean fibre diameter of over 6 μ, wherein the weight component of glass fibres of the first kind in the glass fibre composition is significantly smaller than the weight component of glass fibres of the second kind, in that the ratio between the weight component of glass fibres of the first kind and that of glass fibres of the second kind lies between 0.01 and 0.15, wherein furthermore glass fibres of the first kind within the meaning of the criteria according to the EC Protocol "ECB/TM/27 rev. 7" (Biopersistence of Fibres; Intratracheal Instillation) are not biopersistent and the surface weight of the glass fibre mat lies between 25 g/m$^2$ and 80 g/m$^2$. The properties of the corresponding glass fibre mat make it particularly suitable, especially with regard to the use described above, although they also allow a use of the glass fibre mat according to the invention associated with significant advantages in a series of other applications, in which similar requirements are made of the glass fibre mat (see below). One aspect which is to this extent significant and entirely surprising in this context is that despite its relatively low surface weight of between 25 g/m$^2$ and 80 g/m$^2$, which is even lower than the typical surface weight of known glass fibre mats used and suitable for similar applications, which contain no microfibres, and therefore despite the smaller proportion of stronger glass fibres to this extent, compared with traditional glass fibre mats with only one kind of glass fibres, the glass fibre mat according to the invention exhibits no significant loss in terms of mechanical properties such as strength, in particular, wherein at the same time, however, the risk that (in the preferred application described above) PVC paste penetrates through the glass fibre mat and forms lumps on the back side is significantly reduced compared with the relevant prior art. At the same time, when the glass fibre mat according to the invention is used, compared with the state of the art, the surface of the finished floor covering can be improved by minimizing irregularities on the usable side. It should furthermore be emphasized that the need for PVC paste, which is required in order to impregnate the glass fibre mat, can be reduced when using the glass fibre mat according to the invention, namely without the bond between the glass fibre mat and the impregnation being adversely affected as a result of this. Because the microfibres, i.e. glass fibres of the first kind exhibiting a mean fibre diameter of under 6 μm are furthermore not biopersistent (see above), the glass fibre mat according to the invention and the products manufactured using it are non-hazardous from a health perspective; this is because the glass fibres released particularly during processing (particularly at raw edges) can cause no harm in the human body, because they are either not respirable (this is the case with glass fibres of the second kind) or, however, are dissolved in the body by bodily fluids (this is the case with glass fibres of the first kind). To this extent, although glass fibres of the second kind may likewise be non-biopersistent, they need not necessarily be so, which is an important aspect both with regard to flexibility, which concerns the glass used for glass fibres of the second kind, and also with regard to production costs.

Although the use of the glass fibre mat according to the invention, as discussed in detail above, is paramount when it comes to the manufacture of floor coverings, as far as the particular suitability of the glass fibre mat according to the invention is concerned, this is in no way the only possible use. Various aspects presented above, which characterize the glass fibre mat according to the invention, mean that this can also be used instead particularly advantageously for a series of other applications. Something to be particularly mentioned in this case is its use (in the manner of a traditional wallpaper) as a paintable ceiling and wall covering, with which an outstanding surface quality can be achieved with a very small (subsequent) application of paint, wherein furthermore the extremely low tendency for the paint to pass through the mat has a very favourable effect on the bond between the glass fibre mat acting as a ceiling or wall covering and the base concerned. The fact that a very good surface quality can be achieved with a very small amount of wall or ceiling paint is not only an economic aspect in this case. It also means that the weight of the ceiling and wall covering plus the coat of paint, i.e. the painted ceiling and wall covering, is relatively small, which for its part accommodates the bond of the glass fibre mat to the base. These advantageous criteria apply in a very similar manner when using the glass fibre mat according to the invention as the surface coating on a sheet of building material, particularly a mineral ceiling or wall panel, such that the glass fibre mat is applied to the preformed board at the factory (particularly by adhesion or surface lamination). This is because the specific structure of the glass fibre mat according to the invention prevents the adhesive from penetrating through from the back side to the front surface, i.e. the visible side, so that the surface quality of the visible side and the paint adhesion are not adversely affected by adhesive tracks. Likewise, due to its favourable properties, as described, the glass fibre mat according to the invention can be used particularly advantageously as a cover for interior elements, particularly of a motor vehicle, particularly as a cover panel or other interior facing.

The particular advantages of the glass fibre mat set out above are particularly distinct when the mean fibre diameter of glass fibres of the first kind is between 0.5 μm and 6 μm, preferably between 0.6 μm and 3.0 μm, particularly preferably between 0.6 μm and 1.5 μm.

Furthermore, according to another preferred development of the present invention, it is particularly favourable for the mean fibre diameter of the glass fibres of the second kind to be between 6 μm and 13 μm. Particularly in combination with the preferred dimensions of the glass fibres of the first kind, as indicated above, particularly outstanding material properties result, which make the corresponding glass fibre mat particularly attractive for the uses set out above.

Glass fibres of the second kind particularly preferably comprise C-glass and/or E-glass, wherein T-glass for glass fibres of the second kind is also highly suitable for various applications. It is particularly advantageous in this case for glass fibres of the second kind to comprise a mixture of at least two different kinds of glass fibre. If the mixture of glass fibres of the second kind in this respect comprises both C-glass and also E-glass, it is preferable for the proportion of glass fibres comprising C-glass in the mixture of glass fibres of the second kind to be greater than the proportions of glass fibres comprising E-glass, wherein the proportion of glass fibres comprising C-glass in the mixture of glass fibres of the second kind may even be substantially greater within the framework of the present invention than the proportions of glass fibres comprising E-glass. The ratio indicated above is in turn favourable with regard to the particular properties of the glass fibre mat according to the invention described above, as they are useful, particularly in flooring applications. For other applications, however, other ratios may also be entirely favourable, even up to a proportion of 100% of glass fibres comprising E-glass accounting for fibres of the second kind.

According to yet another aspect of the present invention, glass fibres of the second kind particularly preferably have a mean length/diameter ratio of between 500 and 2000. This proportion of glass fibres of the second kind bears a special relationship to the particular function thereof within the glass fibre mat, particularly with regard to mechanical strength (see above).

According to yet another preferred development of the present invention, the ratio between the weight component of glass fibres of the first kind and the weight component of glass fibres of the second kind for typical applications of the glass fibre mat according to the invention is preferably between 0.03 and 0.08, particularly preferably between 0.04 and 0.06. The aforementioned ratio is favourably less than 0.055, ideally less than 0.048. In turn, there result in this case quite particularly advantageous properties of the glass fibre mat according to the invention, particularly with regard to the possible use thereof as a carrier material in CV floor coverings with outstanding properties. In this respect, it is furthermore favourable for typical applications if the surface weight of the glass fibre mat lies between 40 $g/m^2$ and 60 $g/m^2$. For specific applications, very good results can be achieved, however, with values that differ from these, e.g. a ratio between the weight component of glass fibres of the first part and the weight component of glass fibres of the second kind of less than 0.03.

As far as the binding agent of the glass fibre mat according to the invention is concerned, there is significant latitude here, which may particularly take account of the subsequent use of the glass fibre mat according to the invention. Particularly advantageous binding agents are urea resins and polyacrylic acid binders. The binding agent may, however, also comprise polyacrylic acid. Outstanding properties result when the binding agent comprises a mixture of urea resin and a polymer dispersion or a mixture of polyacrylic acid binders and a polymer dispersion.

Likewise, considerable latitude exists on the other hand in relation to the weight component of the binding agent in the glass fibre mat, wherein to this extent the specific binding agent used in each case and also the use of the glass fibre mat can play a part. For the possible use of a CV floor covering as a carrier material, which is paramount in this case, a weight component of the binding agent of between 15% and 35%, preferably of between 20% and 30%, of the total weight of the glass fibre mat is advantageous.

The binder may, depending on the designated subsequent use of the glass fibre mat in each case according to the invention, contain an additive (or a plurality of additives), which may account for up to 50% of the total weight of the binder. The additive (or additives) may specifically modify or else optimize the properties of the binder in this case with regard to the individual determination of the glass fibre mat. Typical additives are, for example, kaolin and $TiO_2$. However, not only can the binder be technically optimized by additives, but additives are also capable of reducing costs by being able to make an expensive binding agent "go further".

With regard to the relationships described above, it is advantageous for typical applications if the porosity of the glass fibre mat lies within the range of roughly 1000 $l/m^2s$ and roughly 3000 $l/m^2s$, wherein a porosity of between roughly 1500 $l/m^2s$ and roughly 2500 $l/m^2s$ is particularly favourable. The above values for a preferred porosity are based on the measurement standard DIN EN IS09237, namely for a differential pressure of 100 Pa.

The present invention according to the above embodiments does not relate exclusively to the untreated glass fibre mat. Instead, the invention also relates particularly to a glass fibre mat pretreated for subsequent specific further processing, particularly provided with additional impregnation, wherein the impregnating agent may be particularly a plastisol or another PVC-based means. Furthermore, the present invention also extends to the finished CV floor covering produced using the glass fibre mat according to the invention, which CV floor covering comprises a usable layer and a structural layer, wherein the structural layer comprises a glass fibre mat according to the invention provided with impregnation (see above).

What is claimed is:

1. A cushioned vinyl floor covering comprising:
- a useable top layer;
- a glass fibre mat in contact with the useable top layer;
- a back foaming layer also in contact with the glass fibre mat; and
- a polyvinyl chloride paste that adheres the back foaming layer to the glass fibre mat, wherein the glass fibre mat comprises:
- (i) a first kind of glass fibres having a mean fibre diameter of less than 6 μm; and
- (ii) a second kind of glass fibres having a mean fibre diameter of more than 6 μm, and
- (iii) a binder comprising a thermoset polymer, wherein the binder lacks an additive.

2. The cushioned vinyl floor covering of claim 1, wherein the first kind of glass fibres have a mean fibre diameter ranging from 0.5 μm to less than 6 μm.

3. The cushioned vinyl floor covering of claim 1, wherein the first kind of glass fibres have a mean fibre diameter ranging from 0.6 μm to 1.5 μm.

4. The cushioned vinyl floor covering of claim 1, wherein the second kind of glass fibres have a mean fibre diameter ranging from more than 6 μm to 13 μm.

5. The cushioned vinyl floor covering of claim 1, wherein the second kind of glass fibres have a mean length-to-diameter ratio ranging between 500 and 2000.

6. The cushioned vinyl floor covering of claim 1, wherein the glass fibre mat has a surface weight ranging from 25 $g/m^2$ to 80 $g/m^2$.

7. The cushioned vinyl floor covering of claim 1, wherein the glass fibre mat has a surface weight ranging from 40 $g/m^2$ to 60 $g/m^2$.

8. The cushioned vinyl floor covering of claim 1, wherein a weight of the first kind of glass fibres is smaller than a weight of the second kind of glass fibres.

9. The cushioned vinyl floor covering of claim 1, wherein a ratio of a weight of the first kind of glass fibres relative to a weight of the second kind of glass fibres ranges from 0.01 to 0.15.

10. The cushioned vinyl floor covering of claim 1, wherein the thermoset polymer comprises a urea resin or a polyacrylic acid.

11. The cushioned vinyl floor covering of claim 1, wherein the binder comprises between 15 wt. % and 35 wt. % of a total weight of the glass fibre mat.

12. The cushioned vinyl floor covering of claim 1, wherein the polyvinyl chloride paste comprises a plastisol.

13. The cushioned vinyl floor covering of claim 1, wherein the polyvinyl chloride paste has a surface weight of about 400 $g/m^2$.

14. The cushioned vinyl floor covering of claim 1, wherein the first kind of glass fibres and the second kind of glass fibres are 100% E-glass.

15. The cushioned vinyl floor covering of claim 1, wherein the first kind of glass fibres and the second kind of glass fibres are made from C-glass and E-glass.

16. The cushioned vinyl floor covering of claim 1, wherein the cushioned vinyl floor covering further comprises a varnish on the useable top layer.

17. A cushioned vinyl floor covering comprising:
- a useable top layer;
- a glass fibre mat in contact with the useable top layer;
- a back foaming layer also in contact with the glass fibre mat; and
- a polyvinyl chloride paste that adheres the back foaming layer to the glass fibre mat, wherein the glass fibre mat comprises:
- (i) a first kind of glass fibres having a mean fibre diameter of less than 6 μm;
- (ii) a second kind of glass fibres having a mean fibre diameter of more than 6 μm; and
- (iii) a binder comprising a thermoset polymer, wherein the binder lacks an additive; and wherein the glass fibre mat has a porosity ranging from 1500 $l/m^2s$ to 2500 $l/m^2s$.

18. The cushioned vinyl floor covering of claim 17, wherein the first kind of glass fibres have a mean fibre diameter ranging from 0.5 μm to less than 6 μm.

19. The cushioned vinyl floor covering of claim 17, wherein the second kind of glass fibres have a mean fibre diameter ranging from more than 6 μm to 13 μm.

20. The cushioned vinyl floor covering of claim 17, wherein a weight of the first kind of glass fibres is smaller than a weight of the second kind of glass fibres.

21. The cushioned vinyl floor covering of claim 17, wherein the thermoset polymer comprises a urea resin or a polyacrylic acid.

22. The cushioned vinyl floor covering of claim 17, wherein the binder comprises between 15 wt. % and 35 wt. % of a total weight of the glass fibre mat.

* * * * *